US009562346B2

(12) United States Patent
Jonsson et al.

(10) Patent No.: US 9,562,346 B2
(45) Date of Patent: Feb. 7, 2017

(54) APPARATUS FOR CONNECTING AN APPLIANCE/TOOL AND A METHOD THEREFOR

(71) Applicant: Rototilt Group AB, Vindeln (SE)

(72) Inventors: Anders Jonsson, Vindeln (SE); Niklas Bjuhr, Vindeln (SE)

(73) Assignee: Rototilt Group AB, Vindeln (SE)

( * ) Notice: Subject to any disclaimer, the term of this patent is extended or adjusted under 35 U.S.C. 154(b) by 0 days.

(21) Appl. No.: 14/433,961

(22) PCT Filed: Oct. 8, 2013

(86) PCT No.: PCT/SE2013/051180
§ 371 (c)(1),
(2) Date: Apr. 7, 2015

(87) PCT Pub. No.: WO2014/058380
PCT Pub. Date: Apr. 17, 2014

(65) Prior Publication Data

US 2015/0240456 A1 Aug. 27, 2015

(30) Foreign Application Priority Data

Oct. 8, 2012 (SE) ..... 1200605

(51) Int. Cl.
*G06F 7/70* (2006.01)
*G06F 19/00* (2011.01)
(Continued)

(52) U.S. Cl.
CPC ..... *E02F 9/24* (2013.01); *E02F 3/364* (2013.01); *E02F 3/3627* (2013.01);
(Continued)

(58) Field of Classification Search
CPC ..... E02F 3/3627; E02F 3/364; E02F 3/3663; E02F 9/268; E02F 9/24; E02F 9/2025; E02F 3/3677
(Continued)

(56) References Cited

U.S. PATENT DOCUMENTS 6,254,331 B1 7/2001 Pisco et al.
2002/0071754 A1 * 6/2002 Fatemi ..... E02F 3/3618 414/723
(Continued)

FOREIGN PATENT DOCUMENTS

SE WO 2012067559 A1 * 5/2012 ..... B66C 3/005
WO WO 2012/067559 A1 5/2012
WO WO 2012/085500 A2 6/2012

*Primary Examiner* — Maceeh Anwari
(74) *Attorney, Agent, or Firm* — Blank Rome LLP

(57) ABSTRACT

The present invention relates to an apparatus for connecting appliances/tools to a tool arm, wherein the apparatus includes: an upper fastening portion (10B) adapted to be supported by a tool arm (2) of a machine; a lower fastening portion (16A) arranged to support at least one appliance/tool (5) to be maneuvered by the machine, wherein the lower fastening portion (16A) has one or more recesses (40,41) arranged to receive corresponding fastening pins (30,31) of the appliance/tool (5) for engagement when connecting the appliance/tool to the apparatus; and at least one locking element (50) arranged to be in a locking position for locking the appliance/tool to the apparatus when the fastening pins are in engagement with the recesses (40,41); wherein the apparatus further includes: at least one first sensor (70) arranged to verify that the locking element (50) occupies a correct locking position; and at least one second sensor (80) arranged to verify correct engagement between the fastening pins (30,31) and the recesses (40,41). The invention also relates to a method.

10 Claims, 3 Drawing Sheets

(51) Int. Cl.

| | |
|---|---|
| ***G06G 7/00*** | (2006.01) |
| ***G06G 7/76*** | (2006.01) |
| ***E02F 9/24*** | (2006.01) |
| ***E02F 3/36*** | (2006.01) |
| ***E02F 9/20*** | (2006.01) |
| ***E02F 9/26*** | (2006.01) |

(52) U.S. Cl.
CPC ..... *E02F 3/3663* (2013.01); *E02F 3/3677* (2013.01); *E02F 9/2025* (2013.01); *E02F 9/268* (2013.01); *Y10T 403/20* (2015.01)

(58) Field of Classification Search
USPC ..... 701/50
See application file for complete search history.

(56) References Cited

U.S. PATENT DOCUMENTS

| | | | | |
|---|---|---|---|---|
| 2009/0223096 | A1* | 9/2009 | Wimmer | E02F 3/3663 37/468 |
| 2014/0212846 | A1* | 7/2014 | Miller | E02F 3/3663 434/29 |

* cited by examiner

APPARATUS FOR CONNECTING AN APPLIANCE/TOOL AND A METHOD THEREFOR

FIELD OF THE INVENTION

The invention relates to an apparatus according to the preamble of claim 1. The invention also relates to a method.

BACKGROUND OF THE INVENTION

It is customary that certain types of heavy machines such as excavators, forestry machines and wood treatment machines have a tool arm, whereupon one or more appliances/tools can be attached by means of a so called quick coupler. Thereby suitable appliances/tools can be swiftly locked to or be made free from the tool arm. It is customary that such a quick coupler can have a locked position, wherein at least one appliance/tool is locked to the tool arm, and an unlocked position wherein the appliance/tool is made free from the tool arm.

FIG. 1 shows a tool arm/working arm or a shaft 2, in this example of an excavator, wherein said working arm 2 carries an upper fastening portion 10A for the mounting of a manoeuvring apparatus 15 which in the shown example includes a combined rotation device and tilting device. The manoeuvring apparatus 15 includes an upper fastening portion 10B for fastening co-operation with the upper fastening portion 10A of the working arm 2. The manoeuvring apparatus 15 further carries a lower fastening portion 16A for fastening co-operation with a fastening portion 16B of an appliance which in the illustrated case is comprised of a digging bucket 5 but can be any another suitable appliance or tool.

The manoeuvring apparatus 15 is an example of an intermediate part 20 being mounted between the working arm 2 and the appliance 5 in order to increase the movement ability of the appliance 5. It should be understood that this series-connected intermediate part 20 can be constructed in many different ways and exhibit a number of different additional characteristics. The intermediate part 20 can of course be left out where no extra characteristics are desired and then direct connection takes place between the parts 10A and 16B.

As is illustrated in the figures, the fastening portion 10B of the intermediate part 20 includes two parallel fastening pins 30, 31 which are arranged to fit into corresponding recesses 40, 41 being provided in the fastening portion 10A of the working arm 2. In a corresponding manner, the fastening portions 16B of the appliance 5 exhibits two parallel fastening pins 30, 31 which are arranged in a corresponding manner as the previously mentioned fastening pins 30, 31. The fastening pins 30, 31 fit into the corresponding recesses 40, 41 being arranged in the fastening portion 16A.

From the above it is to be understood that the appliance 5 can be directly connected without any intermediate part 20, through direct engagement between the fastening portions 10A and 16B. FIGS. 3-5 illustrate the construction of a co-operating pair of fastening portions which for example could be 10A+10B, 16A-16B or 10A-16B.

FIGS. 3-5 show a connecting procedure between for example an upper fastening portion 10A of a working arm 2 and lower fastening portion 16B of for example an appliance 5. The fastening portion 10A includes two first recesses 41 which come into engagement with (the second) fastening pin 31 and at the same time allow a swing movement between the portions 10A and 16B around the fastening pin 31. A connecting operation (or locking operation) is normally initiated through manoeuvring into said engagement (see FIG. 3). Thereupon a swing manoeuvre takes place with the fastening pin 31 as swing axis such that the (first) fastening pin 30 reaches the bottom in two second recesses 40 of the fastening portion 10A. Thereupon locking together of the fastening portions 10A and 10B takes place by bringing forward a locking wedge 50 from an initial position according to FIG. 4 to a locking position according to FIG. 5. Manoeuvring of the wedge is normally performed by a double-acting hydraulic cylinder 51.

FIG. 5 shows that the locking wedge 50 fixes the fastening pin 30 in the recesses 40 at the same time as the fastening pin 31 is fixed in the recesses 41. The above described results in a very secure locking, provided that the locking wedge 50 ends up in correct contact with the fastening pin 30, which is unfortunately not always the case. This could result in that the appliance drops off, whereby a falling appliance risks causing personal injuries as well as material damages. When disconnecting an appliance, the above described connecting procedure is reversed, wherein the locking wedge 50 is re-manoeuvred to its initial position according to FIG. 4.

In order for an operator/vehicle driver visually to be able to establish that the connection has been successful, it is common to use a so called indicator rod 60 which is arranged to follow the movement of the locking wedge 50, whereby a certain protrusion 61 of the rod verifies adequate locking of the appliance. Said visual inspection is sometimes difficult to perform from the driver's cabin.

BRIEF DESCRIPTION OF THE INVENTION

It is an aim of the present invention to provide a solution which entirely or partly solves the problems and/or disadvantages of previously known solutions.

According to one aspect of the invention the above aim is achieved through an apparatus for connecting appliances/tools to a tool arm, wherein the apparatus includes:

- an upper fastening portion (10B) adapted to be supported by a tool arm (2) of a machine;
- a lower fastening portion (16A) arranged to support at least one appliance/tool (5) to be manoeuvred by the machine, wherein the lower fastening portion (16A) has one or more recesses (40,41) arranged to receive corresponding fastening pins (30,31) of the appliance/tool (5) for engagement when connecting the appliance/tool to the apparatus; and
- at least one locking element (50) arranged to be in a locking position for locking the appliance/tool to the apparatus when the fastening pins are in engagement with the recesses (40,41); wherein the apparatus further includes:
- at least one first sensor (70) arranged to verify that the locking element (50) occupies a correct locking position; and
- at least one second sensor (80) arranged to verify correct engagement between the fastening pins (30,31) and the recesses (40,41).

Different embodiments of the above apparatus are defined in the annexed dependent claims.

The invention further relates to a machine including at least one apparatus according to the invention.

Among the many advantages of the present invention i.a. the following could be mentioned: high level of security; can be easily applied as accessory on existing devices; the hydraulic installation of the device is not effected; visual examination from a distance relating to proper fastening of an appliance in question is no longer necessary and can be replaced by control lamps or warning lamps other indicators in the driver's cabin.

The invention also provides possibilities of automatization important parts of the procedure of connecting appliances. The apparatus according to the invention thereby provides both technical and economical advantages.

Further advantages and applications of the invention will be evident from the following detailed description.

BRIEF DESCRIPTION OF DRAWINGS

In the following, embodiments of the invention will be described with reference to the annexed drawings.

DETAILED DESCRIPTION OF THE INVENTION

Figure 1:
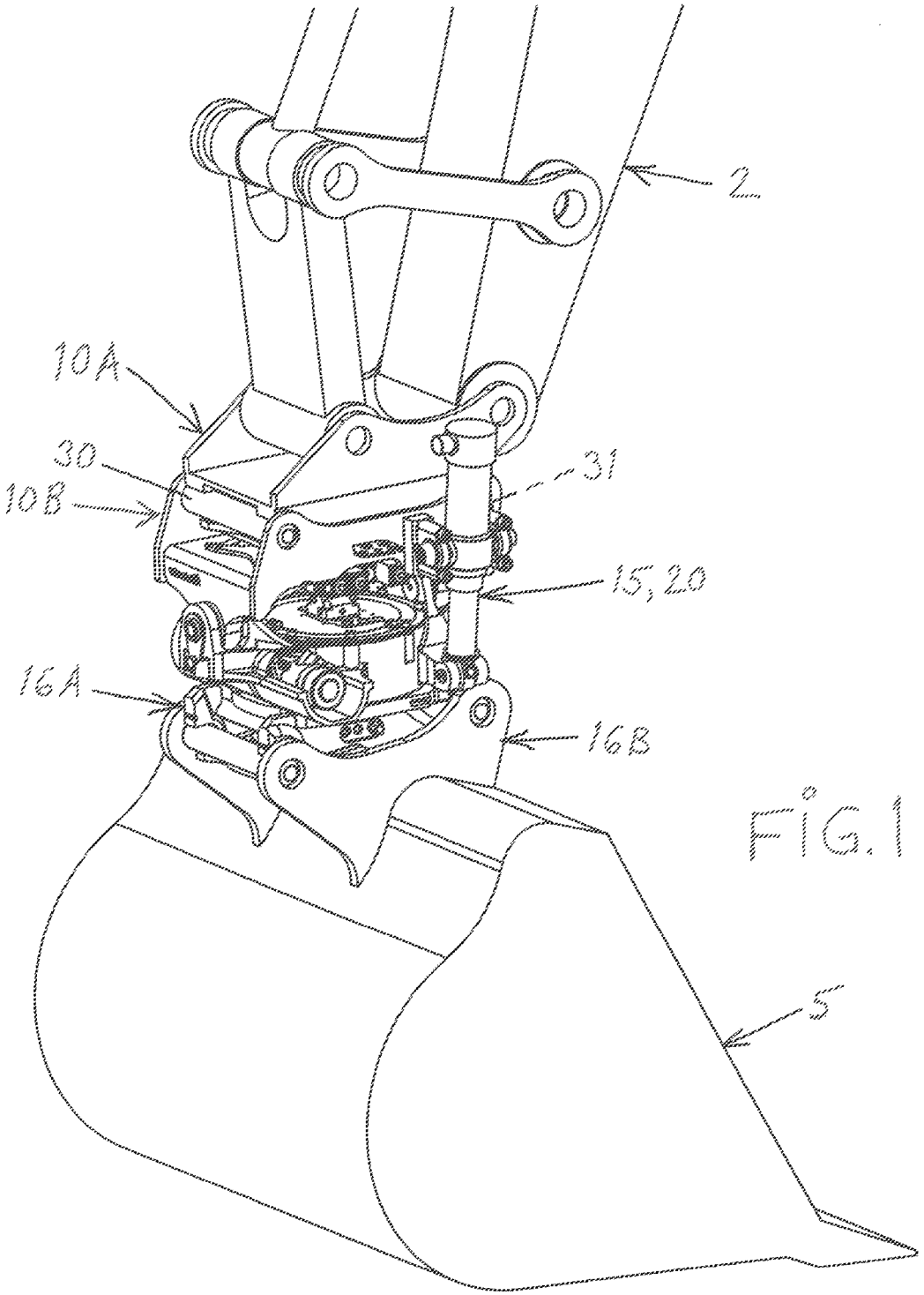
FIG. 1 shows in a perspective view a tip portion of a working arm of an excavator, said arm supporting connected appliances/tools over two appliance holders.
Figure 2:
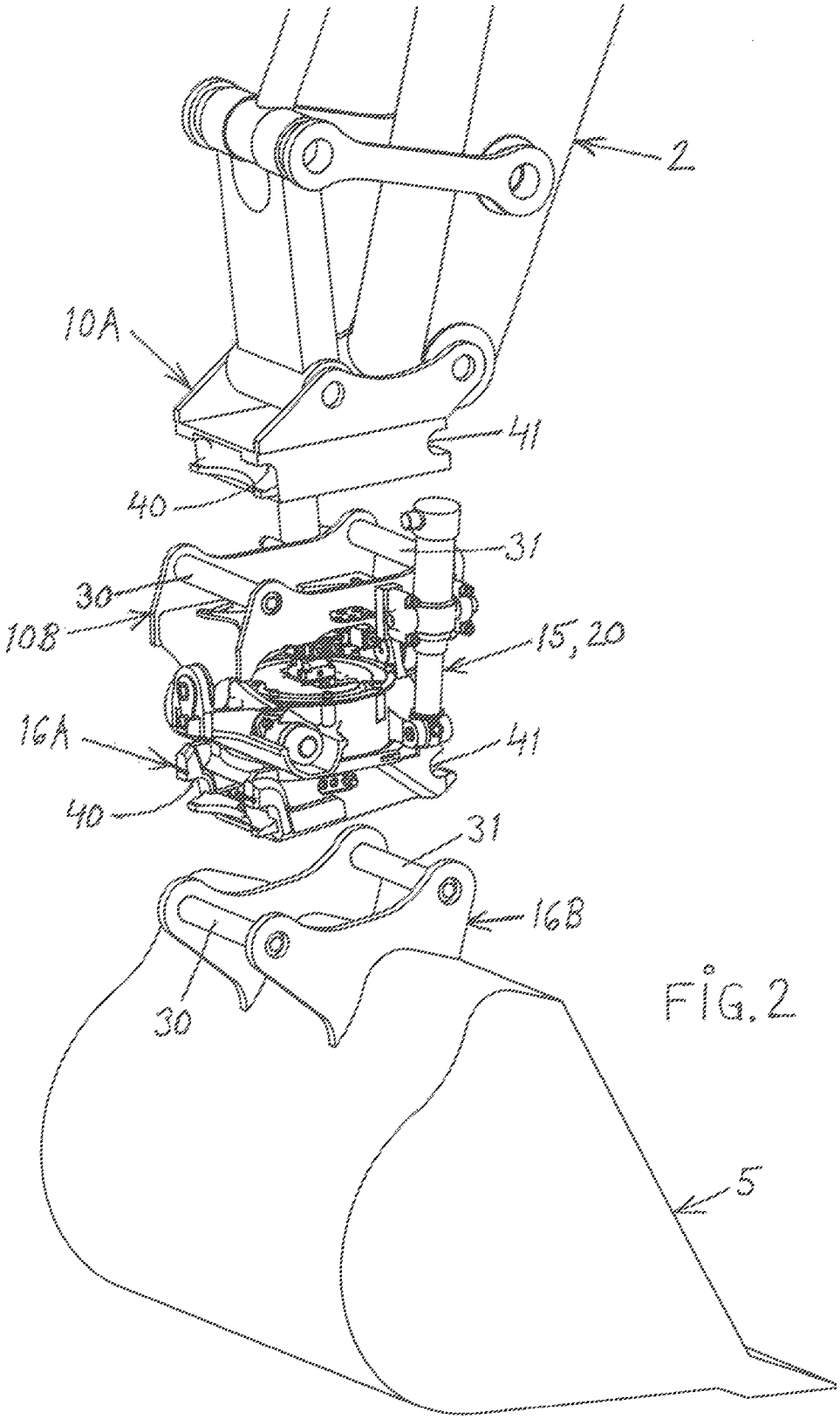
FIG. 2 corresponds to FIG. 1 except that the appliance holders are disconnected such that the appliances/tools are made free from each other.

In order to fulfil the above aims, the invention concerns an apparatus for connecting appliances/tools to a tool arm. As has been described above, the apparatus includes an upper fastening portion 10B being arranged to be supported by a tool arm 2 of a machine such as an excavator, a forestry machine or a wood treatment machine. The apparatus also includes a lower fastening portion 16A arranged to support at least one appliance/tool 5 to be manoeuvred by the machine. The lower fastening portion 16A has one or more recesses 40, 41 adapted to receive corresponding fastening pins 30, 31 of the appliance/tool 5 for engagement with each other when connecting the appliance/tool to the apparatus. Furthermore there is at least one locking element 15 being arranged to be in a locking position for locking the appliance/tool to the apparatus when the fastening pins are in engagement with the recesses 40, 41. Finally, the apparatus includes a first 70 and second sensor 80. The first sensor 70 is adapted to verify that the locking element 50 occupies the correct locking position and the second sensor 80 is arranged to verify correct engagement between the fastening pins 30, 31 and the recesses 40, 41.

Signals from the sensors can be sent to one or more control units for signal treatment and/or control of the functions of a machine. For example, the received verification signals can lead to one or more indicating devices indicating to an operator/driver of the machine that the appliance is securely connected. The indication devices can be in respect of audible, visual or tactile indication, such as light signals, lamps and by vibrators or combinations thereof. The intention is that sufficient information indicating secure connection of the appliance/tool is communicated to the operator/machine driver, which i.a. prevents erroneous connecting, and reduces machine damages and/or personal injury. By using two sensors arranged according to the present invention, the security level is considerably increased compared to solutions according to previously known art.

Further, the verification signals per se can be used in different control algorithms by a control system, for example for preventing manoeuvring of the appliance/tool if not verification is received or occurred correctly which results in even higher security level, since certain functions of the machine or the apparatus can be blocked if there has been no correct verification. The signals can be sent over suitable communication routes such as over communication busses (for example CAN-bus) or over thread-less transmission. Suitable protocols for such transmission are well known to the person skilled in the art and are for that reason not further discussed in this description. As concerns the control system, it can for example comprise signal entrances, signal exits, processors, memories, control programs etc. which are well known to the person skilled in the art.

From the above it is hereby clarified that suitably electrical signals from the sensors can be communicated over conduits or by thread-less communication to the control panel of the machine over control units such that the operator/driver can receive information for correct action and establish satisfactory result of the connection. Also possibilities of automation with suitable control algorithms are of course at hand with the inventive sensor concept which has been discussed above.

The control is often performed with programmed instructions. These programmed instructions are typically comprised of a computer program, which when it is executed in a computer or control unit results in that the computer/control unit performs the desired control, such as processes/methods according to the present invention. The computer program is usually comprised of a part of a computer program product where the computer program product includes a suitable storing medium with the computer program 109 stored on a suitable storage medium. Said digital storage medium can for example be comprised of any one from the group: ROM (Read-Only Memory), PROM (Programmable Read-Only Memory), EPROM (Erasable PROM), Flash memory, EEPROM (Electrically Erasable PROM), a hard disc unit, etc., and be arranged in or in connection with the control unit, wherein the computer program is executed by the control unit.

It is further understood that many different types of sensor means or detector means can be used within the scope of the invention. Also electrical switches can comprise position sensors.

According to an embodiment of the invention, the apparatus is a combined rotation and tilting device by which the appliance/tool can be rotated around a rotation axis and be tilted around a tilting axis.

According to another embodiment of the invention, the apparatus includes an elongated rod 60, which is arranged to follow a movement of the locking element 50 for verifying that the locking element 50 is in the correct locking position. Such a rod is shown in the FIGS. 3-5 and is used according to the background art for visual inspection. According to this embodiment, the first sensor is arranged to detect the position of the rod for verifying that the locking element 50 is occupying the correct locking position. The rod can be an indicator rod which is already present in existing devices according to the background art but can also be a rod following the locking element since the protrusion for visual inspection is no longer necessary.

Preferably the first sensor 70 is an inductive sensor/detector arranged to read the conductive construction or structure of the rod 60, which is the reason that the rod has a non-conductive portion and a conductive portion. This is illustrated in the FIGS. 3-5 through the black portion in the Figures being a conductive portion and the rest of the rod (i.e. the white portions in the figures) are non-conductive portions and can for example be comprised of suitable plastic material or any other non-conductive material.

Figure 3:
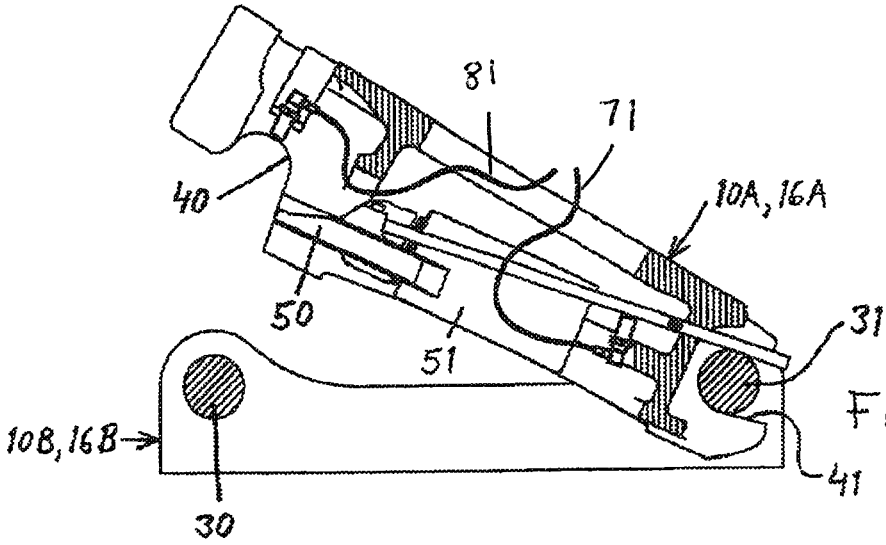
FIG. 3 shows a diagrammatical longitudinal section through an appliance holder during a connection process.
Figure 5:
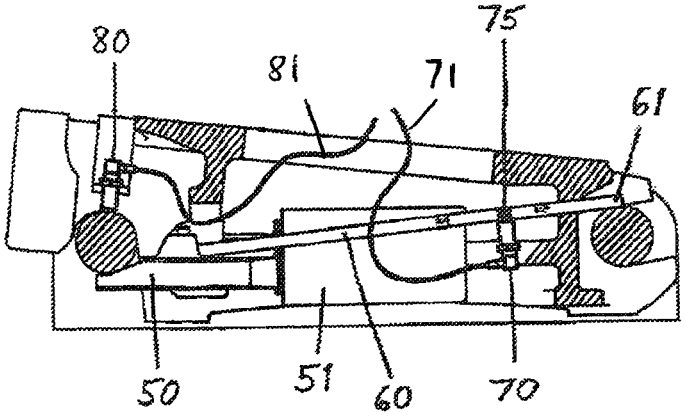
FIG. 5 shows the appliance holder after connection is completed.

FIG. 3 shows a sensor 70 in the form of an inductive sensor for the purpose of detecting the position of the locking wedge 50. In its most simple variant, a metal ring 75, which indicates the position of the locking wedge 50 is arranged on the indicating rod 60 which for example is made of a plastic material. The metal ring 75 is positioned such that it influences the inductive sensor 70 to signal when the locking wedge 50 has reached its correct locking position against the fastening pin 30 as is illustrated in FIG. 5. A conduit 71 for signal communication to the control unit is in this case shown in the Figures.

Alternatively the rod 60 can be made from a metal or any other conductive material with a metal free zone/portion at a desired indicating position. Thereby the system can receive a continuous sensor signal except at correct locking position, whereby the correct function of the sensor can be continuously verified by the control system.

Figure 4:
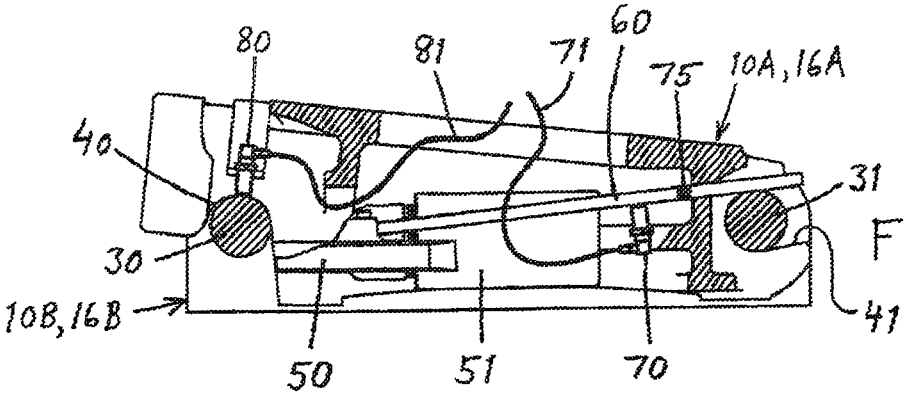
FIG. 4 shows a diagrammatical longitudinal section through the appliance holder when the holder is brought together into an adequate final position but is not locked together.

According to a further embodiment of the invention, the second sensor 80 is arranged at a bottom part of recess as is shown in FIGS. 3-5. Preferably, the second sensor 80 is an inductive sensor arranged at the bottom region of the recess 40 in order to verify without contact that a fastening pin 30 has reached the bottom of the recesses 40 such that the locking element 50 can be manoeuvred to its locking position according to FIG. 5. A conduit 81 for signal communication to the driver's cabin is shown in the figures. With this embodiment, the positioning of the sensor results in that the verification of the locking position of the locking element is easily performed and further, the inductive solution results in that no part of the sensor protrudes out from the recess which would be a great disadvantage since it could be obstructing the fastening pin during connection.

As is shown in the FIGS. 3-5, the locking element according to another preferred embodiment of the invention is a locking wedge, which in this case is manoeuvred with the aid of a hydraulic cylinder. Locking together of the fastening portions 10A and 16B is in this embodiment preformed by manoeuvring forward of the locking wedge 50 from an initial position according to FIG. 4 to a locking position according to FIG. 5 such as it blocks the position of the fastening pin in the recess. The manoeuvring of the wedge is with the aid of the hydraulic cylinder 51 which can be double-acting. Hydraulic conduits have been excluded in the figures for clarity reasons.

In the embodiment where the apparatus includes a locking wedge and a hydraulic cylinder described above, the apparatus can also include a third sensor for verification, which, however, is not shown in the annexed figures. The third sensor is arranged to detect a movement of the hydraulic cylinder in order to verify that the locking element (50) is in the correct locking position. Thereby is provided still a further sensor in order to verify correct connection.

It should be clear that the components/portions/elements shown in this description, within the scope of the inventive idea, can of course be exchanged to functional equivalent components/portions/elements. The invention is thus not limited to the shown and described embodiments, and amendments, modifications and additions are thus possible within the scope of the protection of the following claims.

The invention claimed is:

1. Apparatus for connecting appliances/tools to a tool arm, wherein the apparatus includes:

an upper fastening portion adapted to be supported by a tool arm of a machine;

a lower fastening portion arranged to support at least one appliance/tool to be maneuvered by the machine, wherein the lower fastening portion has one or more recesses arranged to receive corresponding fastening pins of the appliance/tool for engagement when connecting the appliance/tool to the apparatus; and at least one locking element arranged to be in a locking position for locking the appliance/tool to the apparatus when the fastening pins are in engagement with the recesses;

wherein the apparatus further includes:

at least one first sensor arranged to verify that the locking element occupies a correct locking position; and at least one second sensor arranged to verify correct engagement between the fastening pins and the recesses;

wherein the apparatus is a combined rotation and tilting device by which the appliance/tool can be rotated around a rotational axis and can be tilted around a tilting axis.

2. Apparatus according to claim 1, further including an elongated rod which is adapted to follow a movement of the locking element so as to verify that the locking element is in the correct locking position.

3. Apparatus according to claim 2, wherein the first sensor is arranged to detect a position of the rod in order to verify that the locking element is in the correct locking position.

4. Apparatus according to claim 3, wherein the first sensor is an inductive sensor arranged to read the conductive structure of the rod.

5. Apparatus according to claim 4, wherein the rod includes a non-conductive portion and a conductive portion.

6. Apparatus according to claim 1, wherein the second sensor (80) is arranged at a bottom region of a recess.

7. Apparatus according to claim 6, wherein the second sensor is an inductive sensor.

8. Apparatus according to claim 6, wherein a third sensor is arranged to detect a movement of the hydraulic cylinder in order to verify that the locking element is in the correct locking position.

9. Apparatus according to claim 1, wherein the locking element is a locking wedge, which is maneuvered with a hydraulic cylinder.

10. An excavator, a forestry machine or a wood treatment machine including at least one apparatus, comprising:

an upper fastening portion adapted to be supported by a tool arm of a machine;

a lower fastening portion arranged to support at least one appliance/tool to be maneuvered by the machine, wherein the lower fastening portion has one or more recesses arranged to receive corresponding fastening pins of the appliance/tool for engagement when connecting the appliance/tool to the apparatus; and at least one locking element arranged to be in a locking position for locking the appliance/tool to the apparatus when the fastening pins are in engagement with the recesses;

wherein the apparatus further includes:

at least one first sensor arranged to verify that the locking element (SO) occupies a correct locking position; and at least one second sensor arranged to verify correct engagement between the fastening pins and the recesses;

wherein the apparatus is a combined rotation and tilting device by which the appliance/tool can be rotated around a rotational axis and can be tilted around a tilting axis.

* * * * *